US009010760B2

(12) United States Patent
McMillan, III

(10) Patent No.: US 9,010,760 B2
(45) Date of Patent: Apr. 21, 2015

(54) TARGET APPARATUS UTILIZING LASER LIGHT TO ACTUATED TARGET ADVANCEMENT WITH A SUPPORTIVE BACKING ALLOWING TARGETS OF INEXPENSIVE OR RECYCLED ROLL PAPER

(76) Inventor: Edward Lee McMillan, III, Pfafftown, NC (US)

( * ) Notice: Subject to any disclaimer, the term of this patent is extended or adjusted under 35 U.S.C. 154(b) by 158 days.

(21) Appl. No.: 12/924,661

(22) Filed: Oct. 2, 2010

(65) Prior Publication Data

US 2011/0109900 A1 May 12, 2011

Related U.S. Application Data

(60) Provisional application No. 61/248,351, filed on Oct. 2, 2009.

(51) Int. Cl.
*F41J 7/00* (2006.01)
*F41J 1/10* (2006.01)

(52) U.S. Cl.
CPC ..... *F41J 1/10* (2013.01); *F41J 7/00* (2013.01)

(58) Field of Classification Search
CPC ..... F41J 1/00; F41J 1/10; F41J 7/00; F41J 7/02; F41J 7/04; F41J 7/06; F41J 13/00; F41J 13/02; A63B 2063/06; A63B 2063/065; A63B 63/06
USPC ..... 273/403–410, 359, 366–370
See application file for complete search history.

(56) References Cited

U.S. PATENT DOCUMENTS

| | | | | | |
|---|---|---|---|---|---|
| 398,186 | A * | 2/1889 | Rehfuss | 273/404 |
| 1,928,768 | A * | 10/1933 | Sell et al. | 273/409 |
| 1,981,293 | A * | 11/1934 | Varrelman | 273/404 |
| 2,034,839 | A * | 3/1936 | Sheffield | 273/382 |
| 2,231,640 | A * | 2/1941 | Rubin | 273/406 |
| 3,319,960 | A * | 5/1967 | Wilcox | 273/404 |
| 3,514,673 | A * | 5/1970 | Newton | 361/175 |
| 3,519,272 | A * | 7/1970 | De Vogelaere | 273/404 |
| 3,914,979 | A * | 10/1975 | Shofner | 73/28.05 |
| 4,247,116 | A * | 1/1981 | McQuary | 273/394 |
| 4,317,572 | A * | 3/1982 | Iseli | 273/406 |
| 4,523,761 | A * | 6/1985 | Huscher | 273/371 |
| 5,169,157 | A * | 12/1992 | Salmon | 273/407 |
| 5,829,753 | A * | 11/1998 | Wiser | 273/407 |
| 6,257,584 | B1 * | 7/2001 | Nasuti | 273/407 |
| 6,543,778 | B2 * | 4/2003 | Baker | 273/407 |
| 6,761,357 | B2 * | 7/2004 | Witt et al. | 273/407 |
| 7,374,173 | B2 * | 5/2008 | Nasuti | 273/407 |
| 7,784,794 | B2 * | 8/2010 | Sitton | 273/348 |
| 8,141,878 | B2 * | 3/2012 | Kuyl | 273/403 |
| 2005/0025480 | A1 * | 2/2005 | Yeh | 398/12 |
| 2008/0211190 | A1 * | 9/2008 | Smith | 273/407 |

* cited by examiner

*Primary Examiner* — Mark Graham

(57) ABSTRACT

Shooters must presently take their firearms out of their hands to then manually actuate a new target into shooting position. This Target Apparatus will allow the shooter to shine his laser light, infrared light, flashlight, or multi-spectrum light onto a Target Apparatus-mounted sensor that engages a drive means mounted upon the target frame that then forwards a new target into position without removing the firearm from its' shooting position. The unit also uses a unique target backing material that does not require targets to be made of rolls of coated or heavy material stock. The system can utilize rolls of cash register paper, cut sections of gift wrapping paper, hand towel rolls, or even paper towels as target materials without snagging and preventing the next target from being presented.

2 Claims, 6 Drawing Sheets

Front View of Target Apparatus in Total, Reference # 1

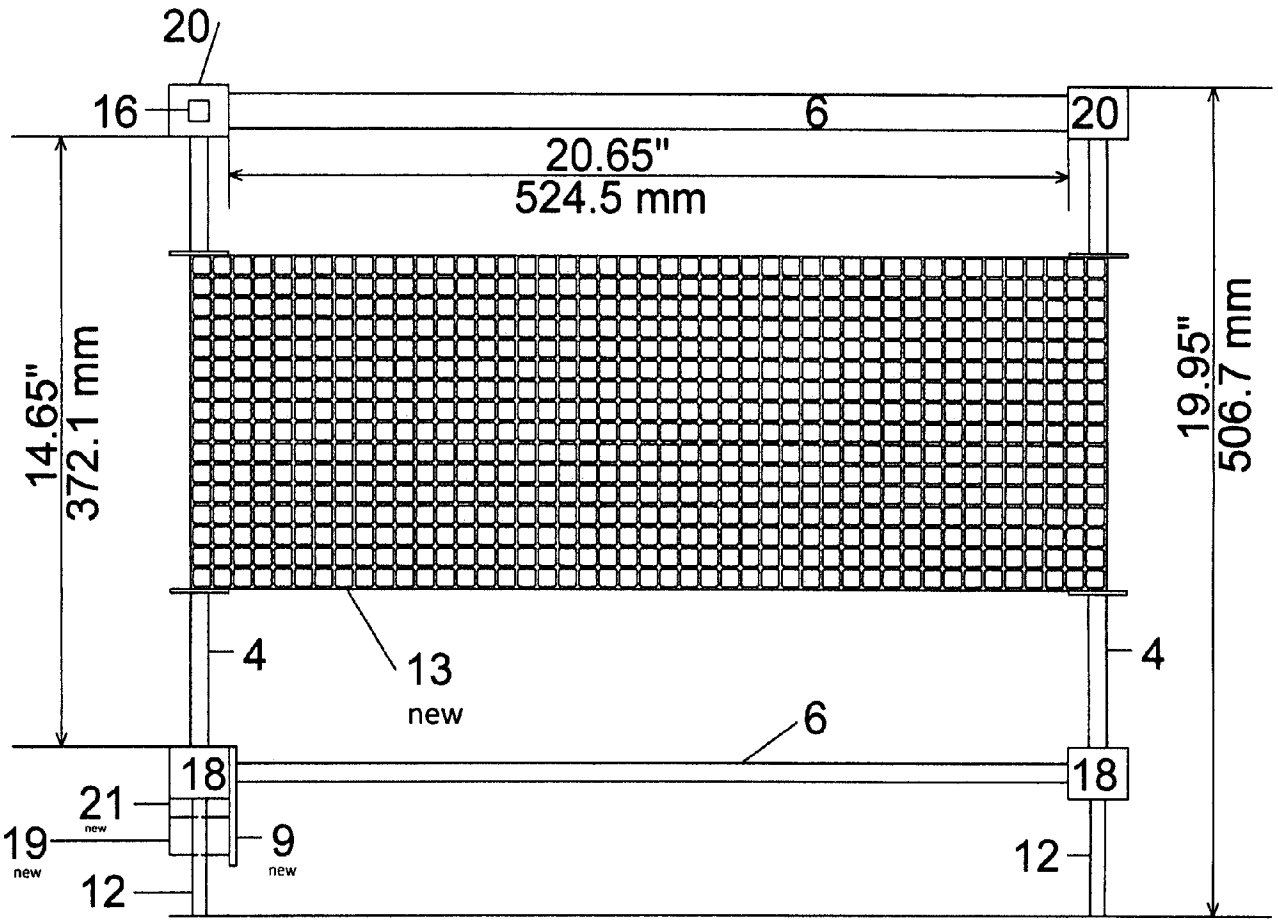
Figure 1, Front View of Target Apparatus in Total, Reference # 1

Figure 2, Right End
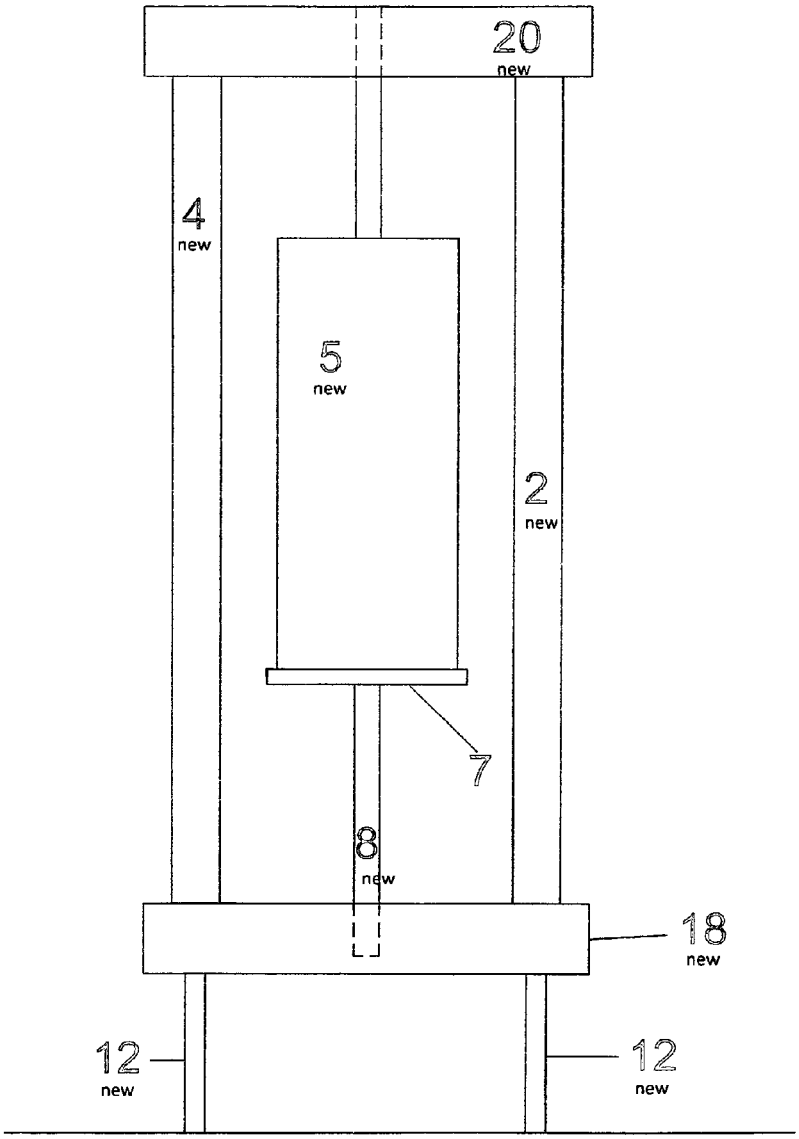

Figure 3, Left End
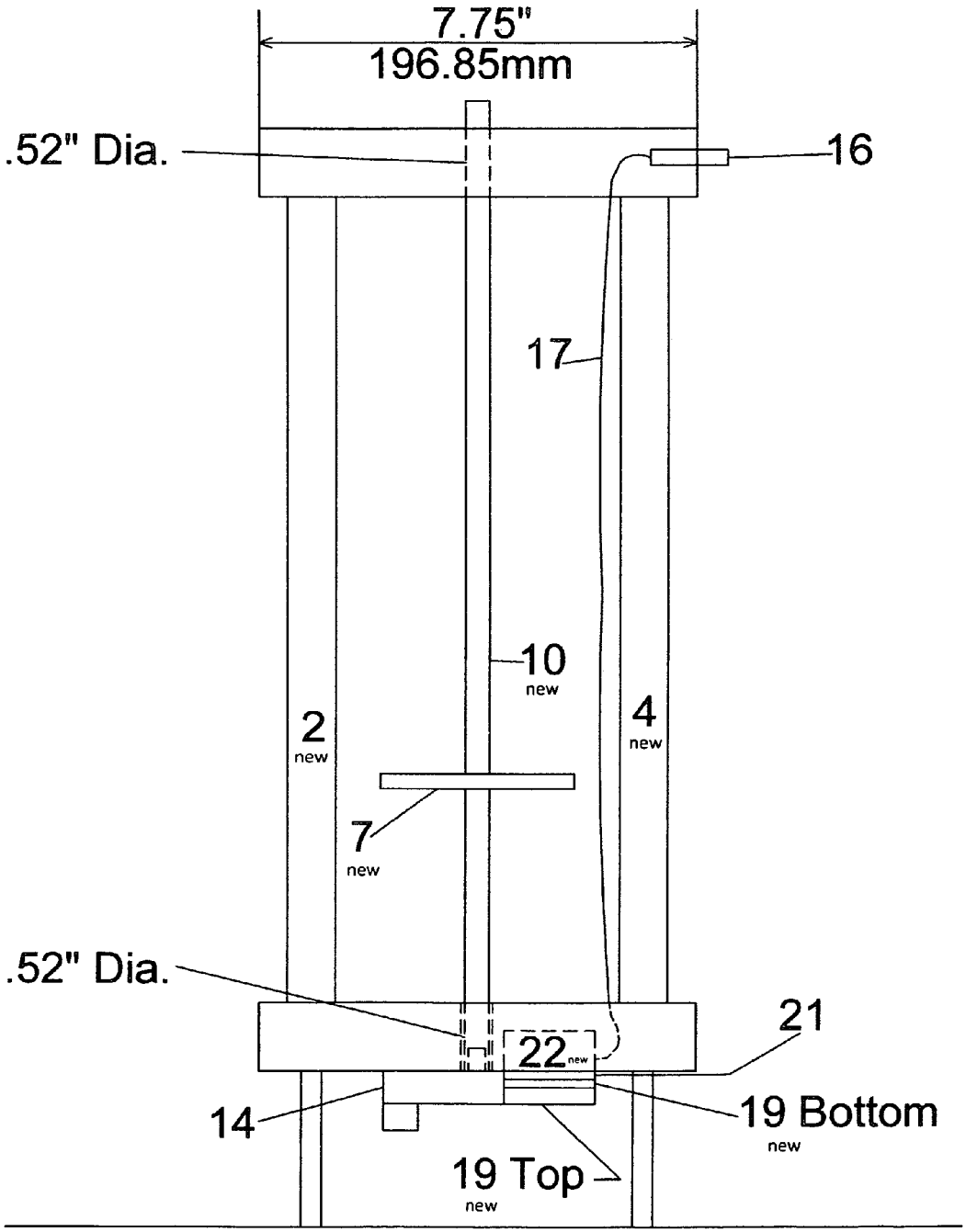

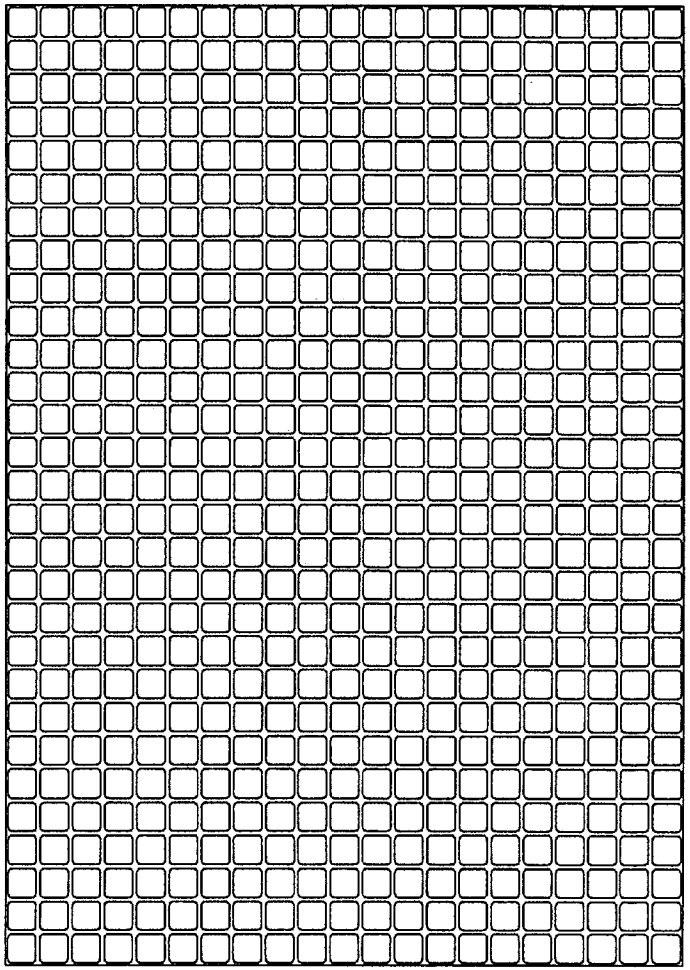
Figure 4, Reference #13 Detail

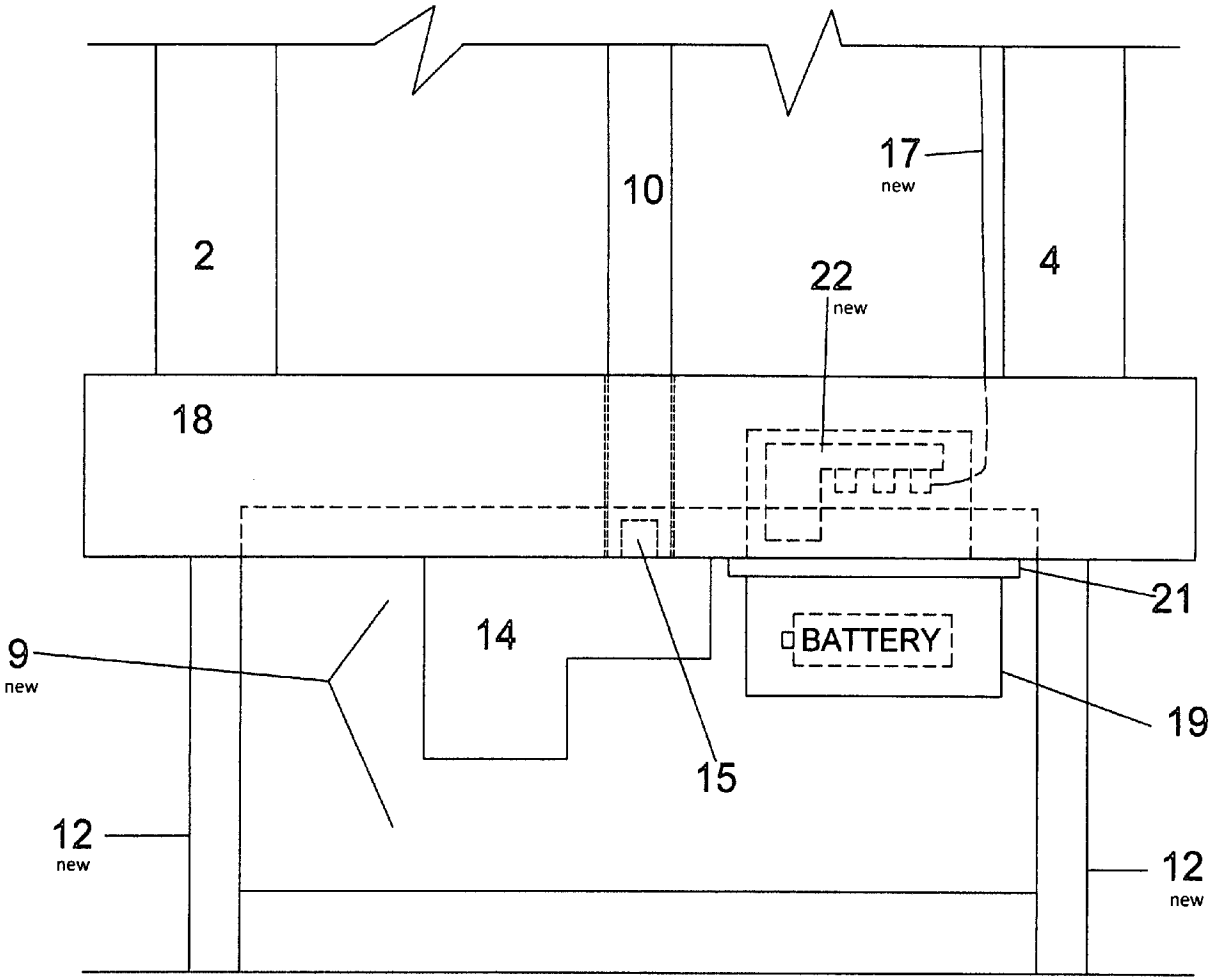
Figure 5, Left End detail of Drive and Shaft Relationship

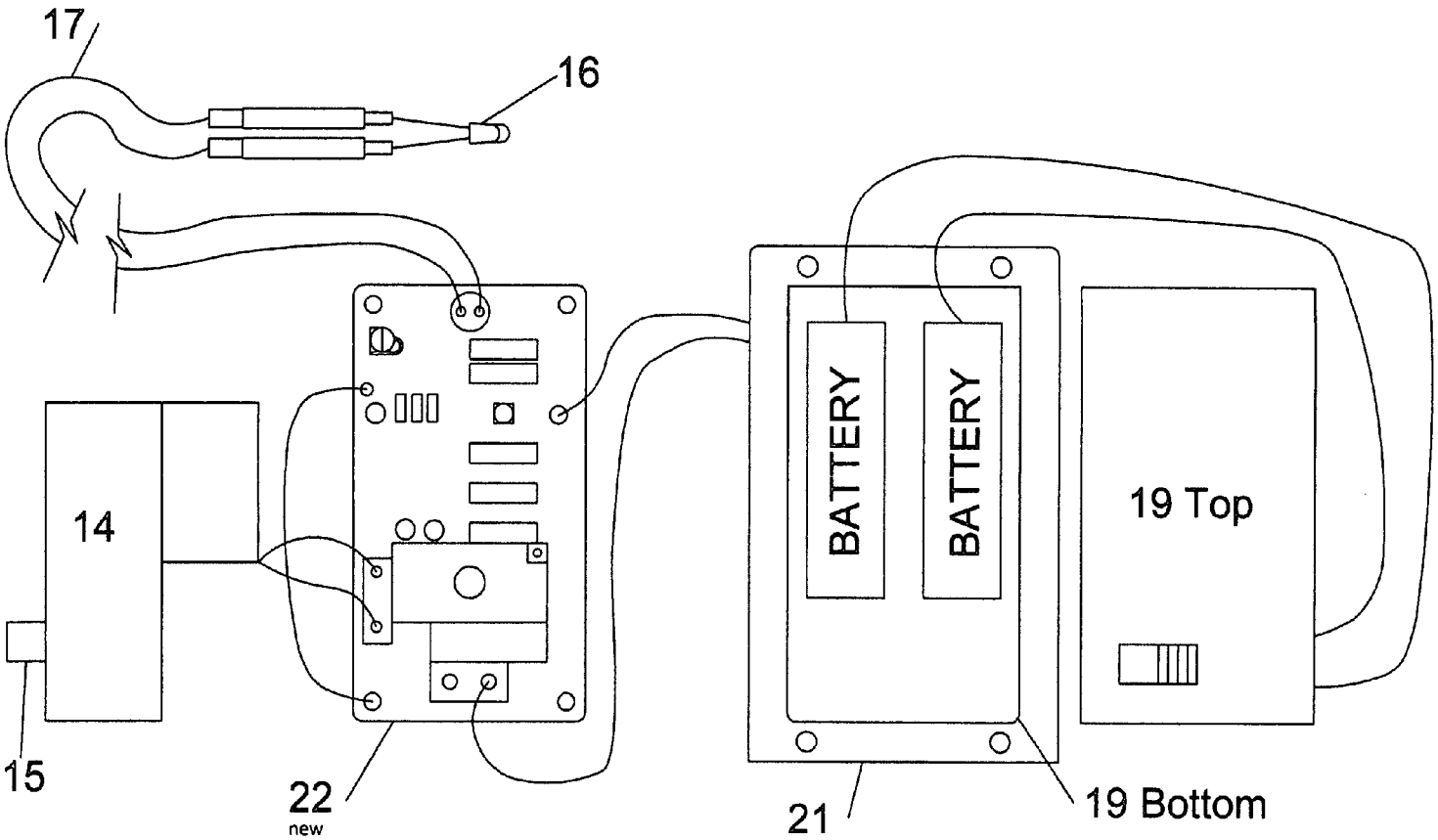
Figure 6, Detail of the relay, switch, battery and motor relationship

TARGET APPARATUS UTILIZING LASER LIGHT TO ACTUATED TARGET ADVANCEMENT WITH A SUPPORTIVE BACKING ALLOWING TARGETS OF INEXPENSIVE OR RECYCLED ROLL PAPER

CROSS-REFERENCE TO RELATED APPLICATIONS

US Patent References

Shooting Target Apparatus Nasuti 273/403
Multifunctional Portable Target Stand
And Dispenser Wiser
Portable Target Holder Hand
Firearm Laser Training System and Kendir 434/21
Method Employing Various Targets
To Simulate Training Scenarios
Target Practice Laser Transmitting/Akano 463/49
Receiving System, Target Practice
Laser Transmitter, and Target Practice
Laser Receiver
Network-Linked Laser Target Firearm Shechter/Rosa 434/21

STATEMENT REGARDING FEDERALLY SPONSORED RESEARCH OR DEVELOPMENT

"Not Applicable"

REFERENCE TO SEQUENCE LISTING, A TABLE, OR A COMPUTER PROGRAM LISTING COMPACT DISC APPENDIX

"Not Applicable"

BACKGROUND OF THE INVENTION

Shooters having to remove their firearms from shooting positions to remotely advance the next target into shooting position and having to use rolls of heavy or specially coated expensive papers as target materials. Shooters have to presently take their firearms out of their hands to then manually advance a new target into shooting position. This unit will allow the shooter to shine his laser sight, infrared light, flashlight, or multi-spectrum light onto a sensor forwarding the next target into position without removing the firearm from its' shooting position. The unit also uses a unique target backing material that does not require targets to be made of rolls of coated or heavy material stock. The system can utilize rolls of cash register paper, cut sections of gift wrapping paper, rolled hand towels or even rolls of paper towels as target materials without snagging and preventing the next target from being presented. The target backing supports the target material upon projectile impact. If portions of the target material should tear and extend into the backing material, the advancement motor will pull the target material across the face of the backing material and it will clear itself of snags.

BRIEF SUMMARY OF THE INVENTION

The present invention solves several issues related to firearm and related projectile practice, competition, and training. The laser displays advantages over the present art. Manual replacement of targets requires the shooter to move downrange in a position in front of the muzzle of the firearm, both theirs and others. The radio solution requires multiple frequencies and complex transmitter/receiver combinations with the requirement of multiple power sources plus very high transmission power that may interfere with medical/communication devices. The laser provides a single universal device to communicate with dozens, hundreds, or even thousands of independent targets at ranges of one foot to 5000+ meters. Speed of training and cost efficiencies are obtained by providing training at a rate two to three times faster than the previous art. There is no downrange travel time, an important plus when considering disadvantaged shooters, plus each trainee resets his own target immediately and moves to the next target thereby, providing the subsequent shooter immediate access to a fresh target displaying time/cost advantages. Previous laser-related art used a sensor to record or display a shot's placement, not activate an electro-mechanical device to advance a fresh target into position. The drive apparatus can be modified, with the addition of a gear and chain, to reset or activate steel or other reactive targets. Current U.S. Army marksmanship training sites utilizes such reactive steel targets on bases across the country.

BRIEF DESCRIPTION OF THE SEVERAL VIEWS OF THE DRAWING

FIG. 1 Present invention front view of Reference No. 1
FIG. 2 Right End view of Reference No. 1
FIG. 3 Left end view of Reference No. 1
FIG. 4 Reference No. 13 detail
FIG. 5 Detail view of FIG. 3 showing the motor and gearset, drive extension from gearset, light activated relay and switch, battery holder, light activated relay and switch cover plate and mounting plate for battery holder and power switch.
FIG. 6 Detail of the Relay, switch, Battery, and Motor Relationship

DETAILED DESCRIPTION OF THE INVENTION

In the preferred embodiment of the invention, the Target Apparatus utilizes light to actuated target advancement across a target backing material allowing the use of inexpensive recycled rolled paper targets.

The device is comprised of the following:

REFERENCE NUMBER AND NAME OF PART

1—Target Apparatus in total
2—Vertical Rear Support
3—
4—Vertical Front Supports
5—Target Material Roll
6—Horizontal Support
7—Adjustable Support Platform for Rolls of Target Material
8—Target Roll Supply Shaft
9—Debris Shield
10—Target Roll Take-Up and Drive Shaft
12—Target Apparatus Riser
13—Target Backing Material
14—Motor and Gearset
15—Drive Extension from Gearset
16—Light Activated Relay and Switch Sensor
17—Wiring from Light Activated Relay and Switch Sensor to the Light Activated Relay and Switch
18—Lower Stand Support
19—Battery Holder, Batteries, and Light Activated Relay and Switch Power Switch
20—Upper Stand Support

21—Light Activated Relay and Switch Cover Plate that also serves as the Mounting Plate for the Battery Holder and Light Activated Relay and Switch Power Switch

22—Light Activated Relay and Switch

*1—The Target Apparatus Reference No. 1 is configured and designed to allow a shooter to shoot and advance targets without removing the firearm from its shooting position in the shooters hands or in relationship to the target. The Target Apparatus Reference No. 1 may comprise any hard, durable material known in the art, including but not limited to wood, metal, and plastic. It is sized to accommodate shooting competition standards.

*2—The Vertical Rear Supports are configured to stabilize the Lower Stand Support Reference No. 18 and the Upper Stand Support Reference No. 20. They are shaped as long, cylinders having a circular cross section, but could take any other shape, such as rods having an oval, rectangle, or hexagonal cross section comprised of any hard, durable material known in the art, including but not limited to wood, metal, and plastic.

*3—

*4—Vertical Front Supports are attached between Lower Stand Support Reference No. 18 and the Upper Stand Support Reference No. 20. The Vertical Front Supports Reference No. 4 also act as axis points for the target material leaving the Target Material Roll Reference No. 5 turning 90 degrees to cross the shooting area, then turning 90 degrees again to be being taken up on the Target Roll Take-Up Drive Shaft Reference No. 10. They are shaped as long, cylinders having a circular cross section, but could take any other shape, such as rods having an oval, rectangle, or hexagonal cross section comprised of any hard, durable material known in the art, including but not limited to wood, metal, and plastic.

*5—Target Material Roll comprise any suitable material that indicates where a projectile penetrated its' surface. Target Roll Materials can be, but are not limited to, adding machine paper, sections of gift-wrapping paper, craft paper rolls, rolls of paper used for disposable table cloths, hand towel rolls and paper towels.

*6—Horizontal Upper and Lower Supports connect the left and right Lower Stand Supports Reference No. 18 and the left and right Upper Stand Supports Reference No. 20. They are long, cylinders having a circular cross section, but could take any other shape, such as rods having an oval, rectangle, or hexagonal cross section that comprise any hard, durable material known in the art, including but not limited to wood, metal, and plastic.

*7—Adjustable Support Platform for Rolls of Target Material holds supply and take-up target material rolls in place so they cross the shooting zone at the same level. They are flat circular discs and comprise any hard, durable material known in the art, including but not limited to wood, metal, and plastic. Friction between the Target Roll Take-up and Drive Shaft Reference No. 10 and the hole drilled in the Adjustable Support Platform holds the platform in place. The same friction relationship exists between the Target Roll Supply Shaft Reference No. 8 and the Adjustable Support Platform.

*8—Target Roll Supply Shaft holds the supply of unused Target Material Rolls Reference No. 5 in place until Target Material is drawn across the shooting area by the Motor and Gearset Reference No. 14. The Target Roll Supply Shaft is a long, cylinder having a circular cross section, but could take any other shape, such as a rod having an oval, rectangle, or hexagonal cross section that comprise any hard, durable material known in the art, including but not limited to wood, metal, and plastic.

*9—Debris Shield is mounted on the inside of the left Lower Stand Support Reference No. 18 and protects the Motor and Gearset Reference No. 14 from the impact of debris should a projectile land short of the Target Apparatus Reference No. 1 and scatter debris. It is displayed in, but not limited to, a rectangular shape extending below the bottom of the Motor, Gearset Reference No. 14 and comprise any hard, durable material known in the art, including but not limited to wood, metal, and plastic.

*10—Target Roll Take-Up and Drive Shaft pulls Target Material from the Target Material Roll Reference No. 5 that is stored on the Target Roll Supply Shaft Reference No. 8 and collects it after the Target Material has been drawn through the shooting area. The bottom of the shaft has a hollow that is keyed to fit the Drive Extension from the Gearset Reference No. 15. The shaft is a long, cylinder having a circular cross section, but could take any other shape, such as a rod having an oval, rectangle, or hexagonal cross section and comprise any hard, durable material known in the art, including but not limited to wood, metal, and plastic.

*12—Target Apparatus Risers support the Target Apparatus Reference No. 1 above the material upon which it is set. A minimum height is required to keep the Motor and Gearset Reference No. 14 above the material upon which the Target Apparatus Reference No. 1 is set. There is no maximum height for these risers. They are shaped as cylinders having a circular cross section, but could take any other shape, such as rods having an oval, rectangle, or hexagonal cross section and comprise any hard, durable material known in the art, including but not limited to wood, metal, and plastic.

*13—Target Backing Material supports the Target Material as it is drawn across the shooting area. This backing prevents the Target Material from twisting or moving in the wind or when impacted by a projectile and allows very inexpensive Target Materials to be used. If segments of Target Material extend into the Target Backing Material, the Motor and Gearset Reference No. 14 will draw the segments out of the Target Backing Material. The Target Material can then proceed to be collected on the Target Roll Take-Up and Drive Shaft Reference No. 10. The Target Backing Material comprise any flexible, durable material known in the art, including but not limited to plastic, nylon, other synthetics, or natural materials.

*14—Motor and Gearset provide the power to draw the Target Material from the Target Material Roll Reference No. 5 that is stored on the Target Roll Supply Shaft Reference No. 8 and move it across the shooting area to be collected on the Target Roll Take-Up and Drive Shaft Reference No. 10. The Battery Holder and Light Activated Relay and Switch Power Switch Reference No. 19 contains the batteries to power the Motor and Gearset Reference No. 14. Direct Current or Alternating Current with or without the use of batteries and AC/DC converters can also be utilized, as well as, Spring Tension Drive Mechanisms can be used in place of the Motor to drive the Target Roll Take-Up and Drive Shaft Reference No. 10.

*15—Drive Extension from the Gearset engages the hollow located in the bottom of the Target Roll Take-Up and Drive Shaft Reference No. 10. The extension is rectangular in shape, but could take any other shape, such as Semi-circular, or hexagonal in cross section and comprise any hard, durable material known in the art, including but not limited to wood, metal, and plastic.

*16—Light Activated Relay and Switch Sensor. Can be mounted in any support on the apparatus or it may be located remotely off of the target system. It is displayed as mounted within the Upper Stand Support Reference No. 20.

*17—Wiring from Light Activated Relay and Switch Sensor to the Light activated Relay and Switch allows remote activation of the Target Apparatus Reference No. 1. The light projected from the shooting position activates the Relay and Switch which then completes the power circuit to engage the Batteries, Motor and Gearset Reference No. 14.

*18—Left Lower Stand Support provides support for the lower portion of the Target Apparatus Reference No. 1. The Left Lower Stand Support provides attachment for the Vertical Rear Support Reference No. 2, the Left Vertical Front Support Reference No. 4, the Horizontal Lower Support Reference No. 6, the Debris Shield Reference No. 9, the Motor and Gearset Reference No. 14, the Target Apparatus Riser Reference No. 12, and provides the access for the Target Roll Take-Up and Drive Shaft Reference No. 10 to pass through and engage the Drive Extension from the Gearset Reference No. 15. The Left Lower Stand also has a cavity holding the Light Activated Relay and Switch Reference No. 22. The Light Activated Relay and Switch Cover Plate Reference No. 21 covers the Light Activated Relay and Switch Reference No. 22 and also serves as the mounting plate for the Battery Holder and Light Activated Relay and Switch Power Switch Reference No. 19. The Right Lower Stand Support Reference No. 18 provides mounting and support for the lower portion of the Target Apparatus Reference No. 1. The Right Lower Stand Support Reference No. 18 provides attachment for the Vertical Rear Support Reference No. 2, the Right Vertical Front Support Reference No. 4, the Horizontal Lower Support Reference No. 6, and the Target Apparatus Riser Reference No. 12. The Lower Stand Support is rectangular in shape, but could take any other shape, such as, but not limited to, Circular, Semi-circular, Oval or Hexagonal in cross section and comprise any hard, durable material known in the art, including but not limited to wood, metal, and plastic.

*19—The Battery Holder, Batteries, and Light Activated Relay and Switch Power Switch Reference No. 19 contains both the battery to power the Light Activated Relay and Switch Reference No. 22 and another battery that is attached to the power entry side of the Light Activated Relay and Switch Reference No. 22. This battery releases its' current when the Light Activated Circuit is completed once the Light Activated Relay and Switch Sensor Reference No. 16 is engaged by a light or laser light source. This current activates the Motor and Gearset Reference No. 14.

*20—The Upper Stand Supports provide Support and for the Upper Portion of the Target Apparatus Reference No. 1. The following are attached to the Upper Stand Shaft Support: the Vertical Rear Support Reference No. 2, the Vertical Front Support Reference No. 4, the Horizontal Upper Support Reference No. 6, and the Light Activated Relay and Switch Sensor Reference No. 16. The Upper Stand Shaft Supports also provide pass-through for the Target Roll Take-Up and Drive Shaft Reference No. 10 and the Target Roll Supply Shaft Reference No. 8. The Upper Stand Support is rectangular in shape, but could take any other shape, such as, but not limited to, Circular, Semi-circular, Oval or Hexagonal in cross section and comprise any hard, durable material known in the art, including but not limited to wood, metal, and plastic.

*21—Light Activated Relay and Switch Cover Plate also serves as a mounting plate for the Battery Holder and Light Activated Relay and Switch Power Switch Reference No. 19 that holds the two battery cells. The Power Switch engages the Light Activated Relay and Switch Reference No. 22. This switch is necessary to prevent the Light Activated Relay from drawing constant power from the battery thereby shortening the battery's life.

*22—Light Activated Relay and Switch

All listed elements are necessary for the invention to work. Optional elements would be related to size only.

The Supports 2,4,6 are connected to Base Supports 18 & 20. Any connections described in this application may include any known connectors, including screws, bolts, adhesives, etc. Target Roll Take-Up Drive Shaft 10 passes through 20 Left and proceeds down through 18 Left and an indent in the bottom of 10 engages the drive extension 15 of 14. Target Roll Supply Shaft 8 passes through 20 Right and rests in a socket in 18 Right. Target Material Rolls 5 are placed in position while 8 is being positioned. The Motor and Gearset 14 is mounted under 18 Left so the drive key aligns in the center of the hole in the base of 18 Left. The Light Activated Relay and Switch Sensor 16 is mounted on the front of 20 Left. Wiring 17 runs from the rear of 16 down behind 4 Left, through 18 Left and connects to the Light Activated Relay and Switch 22. Target Backing Material 13 is mounted between 4 Left and 4 Right. Continuous targets are drawn from the Target Material Roll 5 and rest against the Target Backing Material 13 on their path across the shooting area. When target material is torn from projectile impact (the term projectile comprise but not limited to bullets, pellets, BBs, bolts and arrows) and extends into the Target Backing Material 13, the drive motor will free the torn material from the surface of the Target Backing Material 13.

The shooter shines his laser sight, or other chosen light source, on the Light Activated Relay and Switch Sensor 16 which activates the Light Activated Relay and Switch 22. The normally open circuit is then closed completing the circuit between the battery and drive motor. The motor's drive extension 15, that extends up into the recessed indent of the Target roll Take-up Drive Shaft 10, causes the shaft to rotate and begin drawing Target Roll Material 5 from the Target Roll Supply Shaft 8 causing it to cross the shooting area and eventually be collected on the Target Roll Take-Up Drive Shaft 10. A new target is then ready to be engaged.

To make this invention, one could first provide the elements listed. Then, these elements could be connected using screws, bolts, and adhesives to produce the Target Apparatus 1 as shown in FIG. 1.

This invention could be configured to be very tall when compared to its' width. For example, the shooting area could be 4 feet tall and only 2 feet wide. Different shooting sports will require different configurations.

A shooter would first place the Target Material Roll 5 on the Target Roll Supply Shaft 8. The Target Material Roll 5 rests upon the Adjustable Support Platform 7. The Target material would then be drawn from the supply roll, out and around the Right Vertical Front Support 4, across the Target Backing Support Material, around the receiving Left Vertical Front Support 4 and onto the Target Roll Take-Up Drive Shaft 10. The target material is affixed to the Target Roll Take-Up Drive Shaft with a tape-like adhesive strip or fastener. After engaging the current target, the firearm or bow's laser sight is activated and illuminates the Light Activated Relay and Switch Sensor 16 which, in turn, activates the Light Activated Relay and Switch 22. The Relay located on the Light Activated Relay and Switch 22 then releases current to the Drive motor and the Target Roll Take-Up Drive Shaft 10. A new target is then drawn from the Target Material Roll 5 that is resting on the Adjustable Support Platform 7 on the Target Roll Supply Shaft 8 and the shooter has not left the shooting position or had to re-handle their firearm or bow.

Any rolled material may be drawn from a supply spool with this remote light-activated relay and switch 22. For example, banners could be rolled and unrolled on auditorium ceilings without the expense of installing control cables. The complete light activated mechanism may be configured in the Lower Stand Base Support 18 in such a way as to reset a reactive target that comprise any hard, durable material known in the art, including but not limited to wood, metal, and plastic back into a set position after a projectile has achieved impact. Current US Army Marksmanship Training uses such reactive targets.

Current solutions require twice the firearm handling. The proposed system does not require removing the firearm from a shooting position. The current solution creates twice the opportunity for handling errors and movement of the muzzle off the target line into unsafe positions.

What is claimed:

1. A Target Apparatus comprising:

a motor and gearset;

a drive extension from gearset;

a light activated relay and switch cover plate;

a target backing material;

a battery holder, batteries, and light activated relay and switch power switch;

a light activated relay and switch;

a left lower stand support;

a target roll take-up and drive shaft, a left vertical front support;

a target material roll;

an adjustable support platform for rolls of target material;

a target roll supply shaft;

and a right vertical front support;

wherein said drive extension from gearset is mounted vertically atop said motor and gearset and mounted laterally to said light activated relay and switch cover plate orienting said drive extension from gearset to provide drive capability across said target backing material, and wherein said battery holder, batteries, and light activated relay and switch power switch is mounted on the bottom of said light activated relay and switch cover plate, and wherein said light activated relay and switch is mounted within a cavity in the said left lower stand support and said target roll take-up and drive shaft extends vertically through said left lower stand support to engage said drive extension from gearset which unwraps said target material roll, pierced vertically through the core of said target material roll by the said target roll supply shaft, and resting atop said adjustable support platform for rolls of target material and draws the contents of said target material roll from said right vertical front support, turning 90 degrees to cross the said target backing material, turning 90 degrees around said left vertical front support, and onto said target roll take-up and drive shaft.

2. The invention of claim 1, further comprising:

a light activated relay and switch sensor; and a wiring from light activated relay and switch sensor to the light activated relay and switch;

wherein said light activated relay and switch sensor is soldered to said wiring from light activated relay and switch sensor to the light activated relay and switch, and whereby said light activated relay and switch sensor is activated by, but not limited to, laser, infrared, single-spectrum, and multi-spectrum light sources.

* * * * *